US005228670A

United States Patent [19]

Köbler

[11] Patent Number: 5,228,670

[45] Date of Patent: Jul. 20, 1993

[54] APPARATUS AND METHOD FOR RECEIVING, STORING AND DELIVERING PRINTED PRODUCTS

[75] Inventor: Ingo Köbler, Anhausen, Fed. Rep. of Germany

[73] Assignee: MAN Roland Druckmaschinen AG, Offenbach am Main, Fed. Rep. of Germany

[21] Appl. No.: 850,387

[22] Filed: Mar. 11, 1992

[30] Foreign Application Priority Data

Apr. 30, 1991 [DE] Fed. Rep. of Germany ..... 4114095

[51] Int. Cl.[5] ..... B65H 3/02

[52] U.S. Cl. ..... 271/3; 271/18; 271/34; 271/204; 271/216; 271/277

[58] Field of Search ..... 271/3, 34, 35, 277, 271/198, 204, 216, 18

[56] References Cited

U.S. PATENT DOCUMENTS 3,409,290 11/1968 Bergland ..... 271/187 X
4,647,032 3/1987 Oba ..... 271/315 X
5,029,843 7/1991 Kobler .

FOREIGN PATENT DOCUMENTS 0387726 9/1990 European Pat. Off. .

*Primary Examiner*—Richard A. Schacher
*Attorney, Agent, or Firm*—Frishauf, Holtz, Goodman & Woodward

[57] ABSTRACT

To receive, store and deliver printed products in minimum space, with a device which can, itself, be stored in minimum space when free of products, a steel tape or ribbon (1, 21) is formed with U-shaped cuts (7) to define, within the ribbon, tongues (5, 22). The tape or ribbon is guided in a curved path, typically about a guide roller (4, 23), which causes the tongues to flare out tangentially. When in flared or projecting position, products (8, 33) can be pushed in the space between the extended tongues and the remainder of the tape or ribbon material which, upon then being guided in an essentially linear path, will cause the tongues to close and grip the products, whereupon the tape or ribbon with the products, thereon can be rolled into a storage roll. To release the products, the path of travel of the tape or ribbon or reversed, causing the tongues to open as they pass over the roller (4, 23), and the then empty ribbon can be rolled tightly, since the tongues will fold themselves into the cut-outs from the ribbon and not take up additional space, deflecting in curved position by the pressure of succeeding windings or turns of the rolled ribbon or tape.

15 Claims, 6 Drawing Sheets

APPARATUS AND METHOD FOR RECEIVING, STORING AND DELIVERING PRINTED PRODUCTS

FIELD OF THE INVENTION

The present invention relates to apparatus to receive, store and deliver printed products, which may be single sheets, folded products, or a plurality of sheets or folded products, and to a method of handling these printed products for reception, storage and delivery.

BACKGROUND

It is known to store printed products when wrapped around a carrier ribbon or tape, typically of steel. The carrier ribbon or tape has grippers, to hold the printed products. The carrier ribbon or tape forms a transport device, which can be pulled off a supply roller, supplied with the products to be stored, and then again with the products between layers of the tape and the products, being rolled up to form a storage roll. The process can be reversed for delivery of products, by pulling out the tape with the products thereon, and causing gripper elements to release.

European Patent Application 0 387 726 describes a system of this type, using elastic steel ribbons which have grippers attached thereto. The grippers grip folded products or sheets, in a clock cadence, and then the tape, with the products thereon, is wound up into a roll for storage. If it is not desired to store any printed products, a problem arises in that the storage of the empty tape or roll takes up too much space because the grippers on the ribbon or tape have a substantial volume.

The system of the prior art, as well as that of the present invention, is suitable for storage of any kind of sheet or sheet-like product, whether printed or not, of course. Reference to "printed products", thus, should not be deemed to be limited to products on which information already has been printed; it may relate merely to, for example, supply of sheets or folded sheets or other material on which printing can be effected.

THE INVENTION

It is an object to provide a storage apparatus and method which, when empty, takes up but little space, yet is effective and efficient in handling sheet, or folded sheet, or otherwise sheet-like products, typically printed products, and which is simple and reliable.

Briefly, a flexible tape, preferably a flexible steel tape or ribbon, is formed with a plurality of generally U-shaped tongues, cut into the tape or ribbon. The U-shaped tongues are uniformly spaced from each other along the length of the tape or ribbon and define holding or gripper clips. The tongues, when the tape or ribbon is oriented in a flat plane, are essentially flush with the tape or ribbon material surrounding the tongues. Upon being passed over a guide roller, the tongues will open or spread tangetially outwardly of the tape or ribbon, in which position the products can be inserted between the tongues and the remainder of the material of the tape or ribbon. Upon then being guided in an essentially planar path, the tongues will again close in a direction towards the major plane of the tape or ribbon, and thus grip the products therebetween. The tape or ribbon can then be rolled up, and the pressure of adjacent windings or turns of the roll will hold the products between the tongues. To remove the products, it is only necessary to reverse the path of the products, that is, to pull out the products from the roll in an essentially linear path, and then pass the tape or ribbon over a curved surface, so that the gripper tongues will spread apart and release the products. The empty tape can then be rolled up, and the tongues will resiliently deflect against the rolled ribbon, from which they were cut originally, so that the overall structure takes up no more room than the volume of the rolled ribbon itself.

The products can be fed into the open tongues in two ways—namely in such an arrangement that the tongues grip the products at a trailing edge and push them forward in their initially linear path; or that the tongues grip the products at a leading edge and, upon closing, pull them along.

DRAWINGS

DETAILED DESCRIPTION

Referring first to FIGS. 1-4:

A steel tape or ribbon 1 is delivered from a supply roll 2, by being pulled in the direction of the arrow 3 by a suitable pulling roller, not shown. It is guided about a guide roller 4 where the tape or ribbon 1 is bent.

Figure 4:
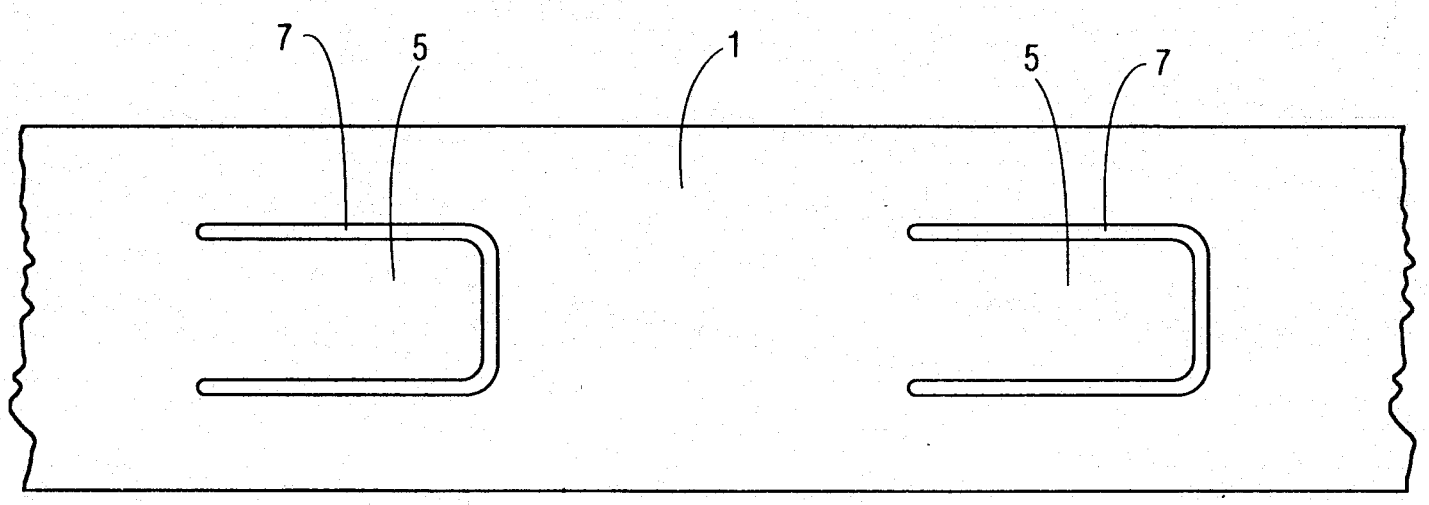
FIG. 4 is an enlarged detail view of the tape or ribbon with the gripper tongues.

In accordance with a feature of the invention, the tape or ribbon 1 has tongues 5 cut therein, which are essentially U-shaped (see FIG. 4). The tongues 5 are formed as cuts 7, leaving the remainder of the material of the tape surrounding the tongues 5. The steel tape 1 and hence also the tongues 5 are flexible. Thus, the tongues 5 can be opened upon bending the steel tape 1; upon guiding the tape 1 in a linear path, the tongues 5 will fit into the cuts 7 in the steel tape 1; and when rolled up without any products therebetween, the tongues 5 can follow the curvature of a roll, forced on the tongues 5 by succeeding layers of the roll.

Figure 1:
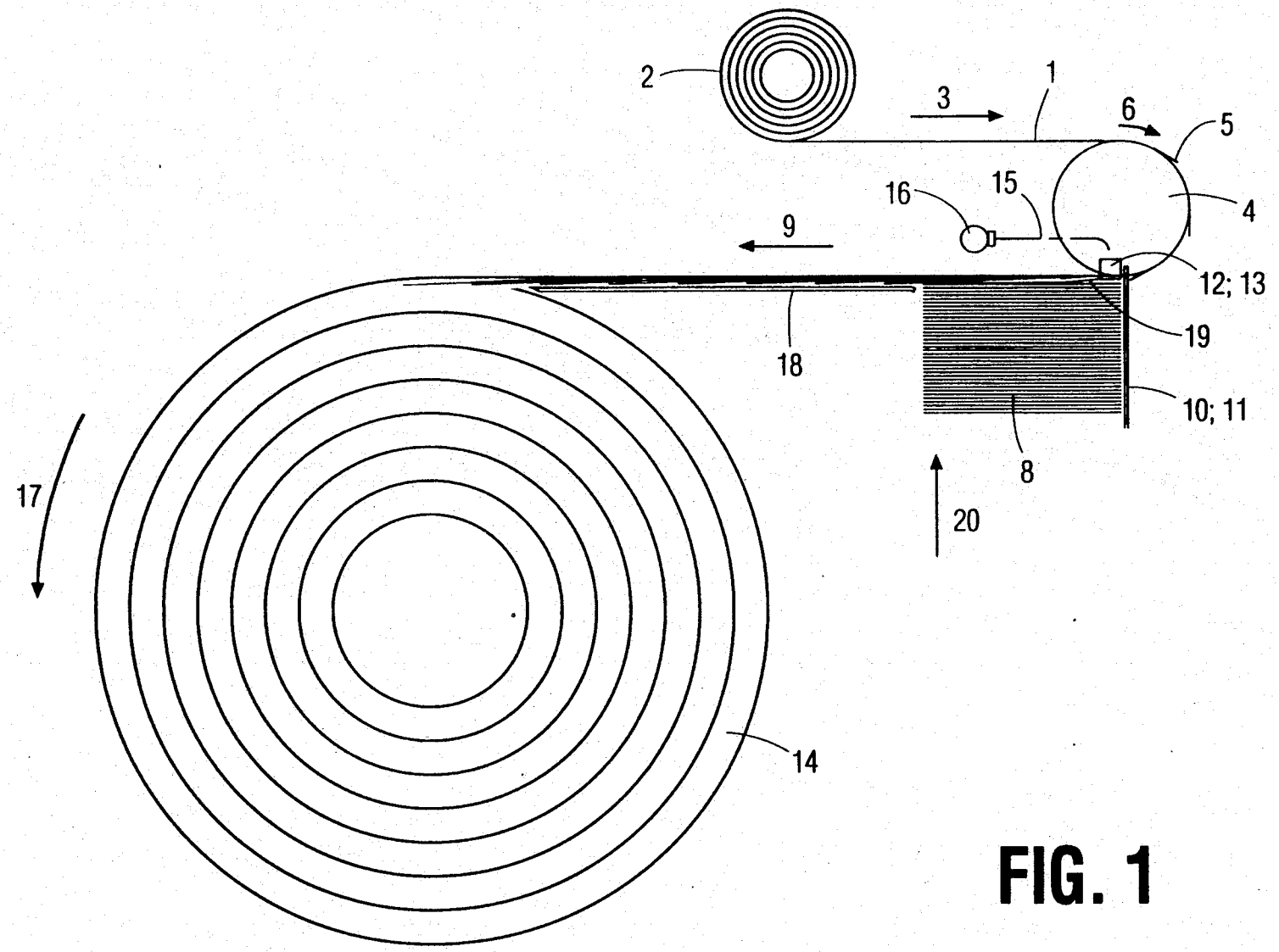
FIG. 1 is a general overall view of an apparatus and device to receive, store and deliver printed products, and used in connection with an explanation of the method.
Figure 2:
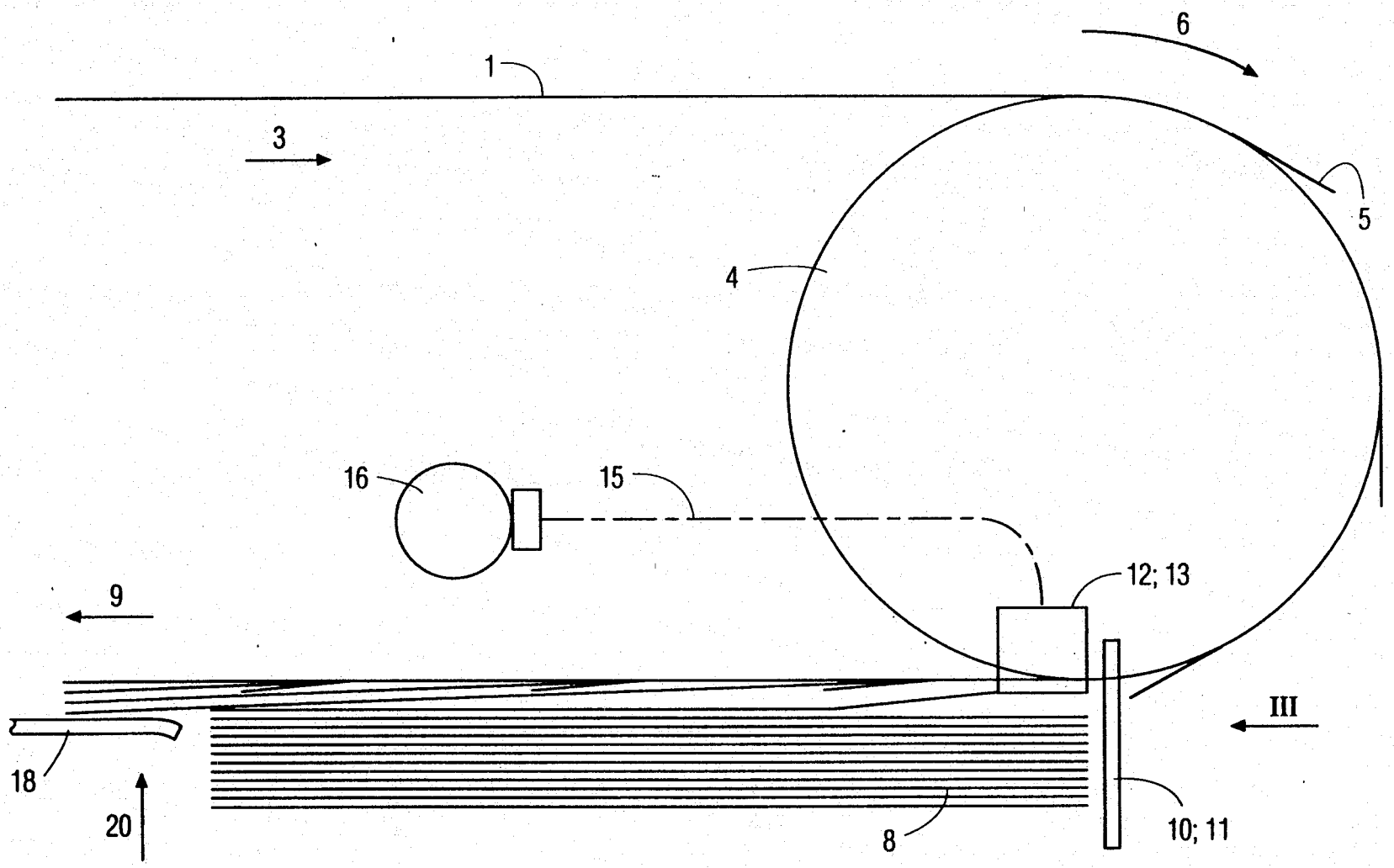
FIG. 2 is a fragmentary detail view to a larger scale of a portion of FIG. 1.
Figure 3:
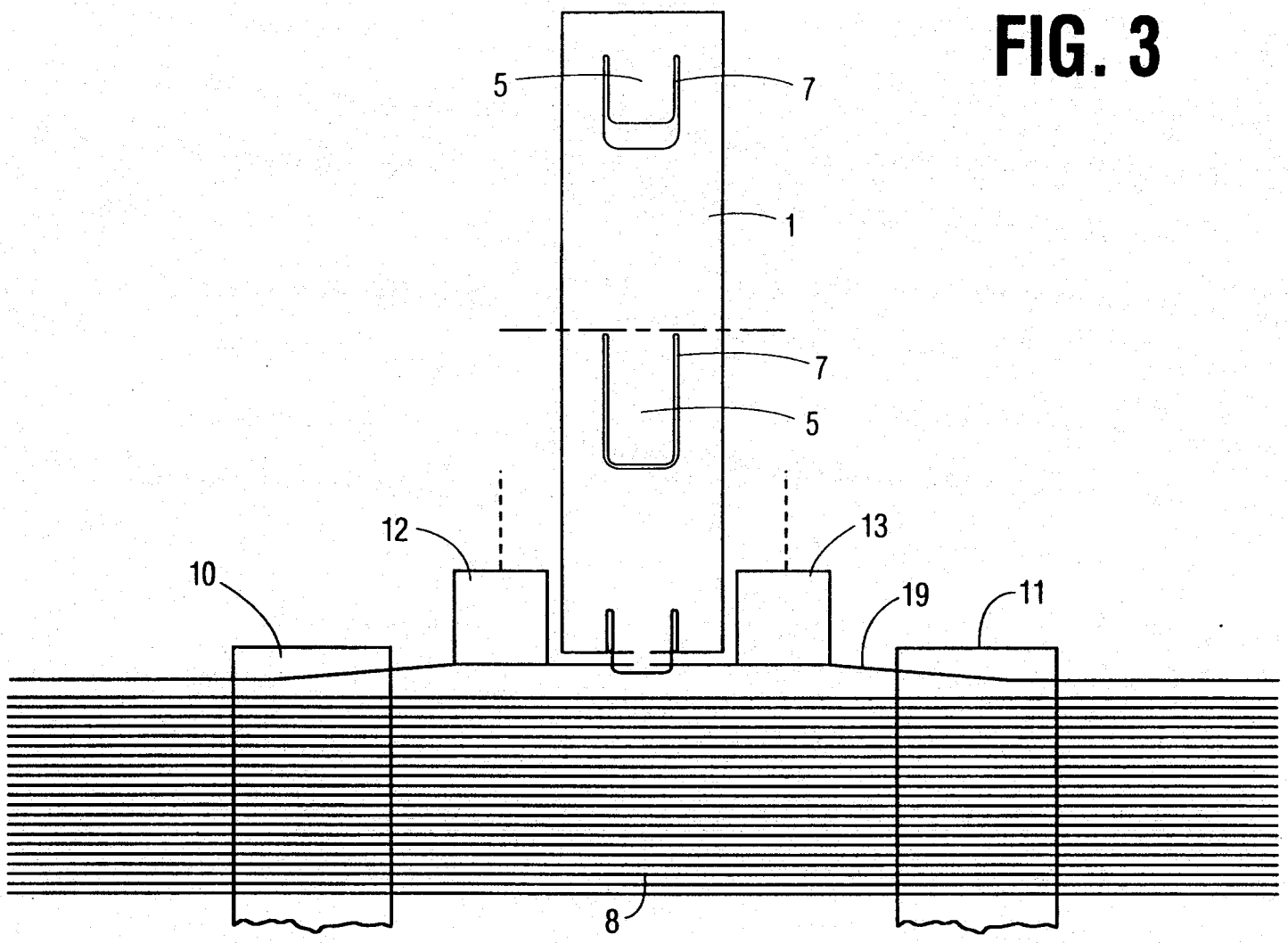
FIG. 3 is a view of the device taken in the direction of the arrow III of FIG. 2.

The storage device and system, thus, utilizes the ribbon 1 with the tongues 5 which, upon being passed about the roller 4, which rotates in the direction of the arrow 6, will spread out or flare out tangentially, with respect to the roller 4. The openings of the tongues 5 face in the direction of rotation 6 of the tape 1. As known, a height adjustable stack 8 of single sheets, or folded sheets, are located beneath the guide roller 4. Engagement and alignment bars or plates 10, 11 (FIG. 3) are located at a side of the stack 8 remote from the further direction of transport of the tape 1 as shown by the arrow 9. As best seen in FIG. 3, fixed suction heads 12, 13 are located laterally of the guide roller 4. The suction heads 12, 13 are connected to a vacuum supply 16 via vacuum lines 15 (FIG. 2). A portion of the steel tape 1, with products gripped thereon, is seen in FIG. 1 already rolled as a roll 14, which rolls the tape with products thereon by rotation in the direction of the arrow 17. The space between the stack 8 and the roll 14 is bridged by a table or rail system 18.

As clearly seen in FIGS. 2 and 3, the tongues 5 function as grippers. The tongues 5 open when they are being passed about the curved surface of the roller 4 in the direction of rotation of the roller, as seen by arrow 6, until they can grip the trailing edge of a product 19. To facilitate pick-up of the product, for example a folded product, the suction heads 12, 13 lift the products at the location where the tongues project beneath the product, see FIG. 2. After the tongues have been guided about the guide roller 4, and are again guided in a linear path, for example by the rails or table 18, the tongues 5 close and grip the product 19, thereby clamping the product 19 between the tongue and the remainder of the material of the steel tape 1. The folded or single sheets or multiple sheets, whether straight or folded, of the products 19 are carried along upon further transport and moving of the tape or ribbon 1 in the direction of the arrow 9. They are simultaneously pulled away from the suction heads 12 and 13 so that the next sheet or folded product 19 is lifted upwardly from the stack 8.

The stack 8 is raised upwardly, as well known, by a suitable raising or feed drive for uniform feed of products 19 from the stack 8.

After passing the delivery device 18, e.g. a table or rail system, the steel tape 1, with the products 19 held in the tongues 5, can be rolled up to form the supply or storage roll 14.

To release the product, for example for further handling, the direction of movement of the tape 1 is reversed, that is, counter the direction of the arrows 17, 9, 6, 3. This, upon passage of the tape 1 over the roller 4, causes the tongues to open and release the products 19 for stacking. The engagement rods or plates or other engagement elements 10, 11 are provided to form an alignment arrangement for the then leading edge of the products.

The system, as seen, readily permits pick-up of sheets, groups of sheets, or folded products 19, to store them, and release them again for further handling. Additionally, the empty roll will take up only little space since the tongues can fold themselves into the plan outline of the tape or ribbon, even when wound up in an empty ribbon roll 2 (FIG. 2).

Figure 5:
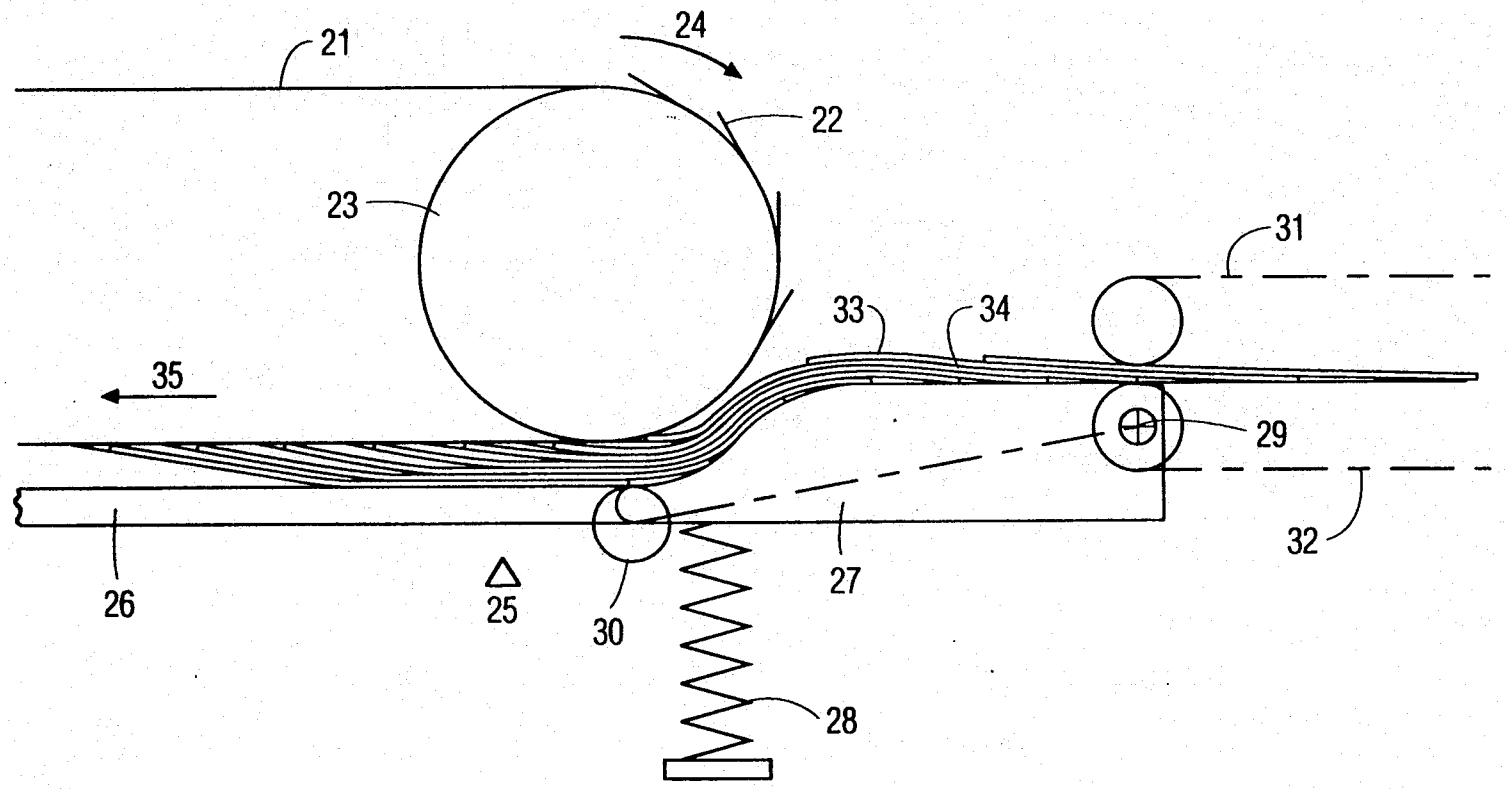
FIG. 5 illustrates the storage system and device particularly suitable to receive printed products delivered in imbricated or shingled form, and in which the products have a considerable thickness, for example a several ply folded products.
Figure 6:
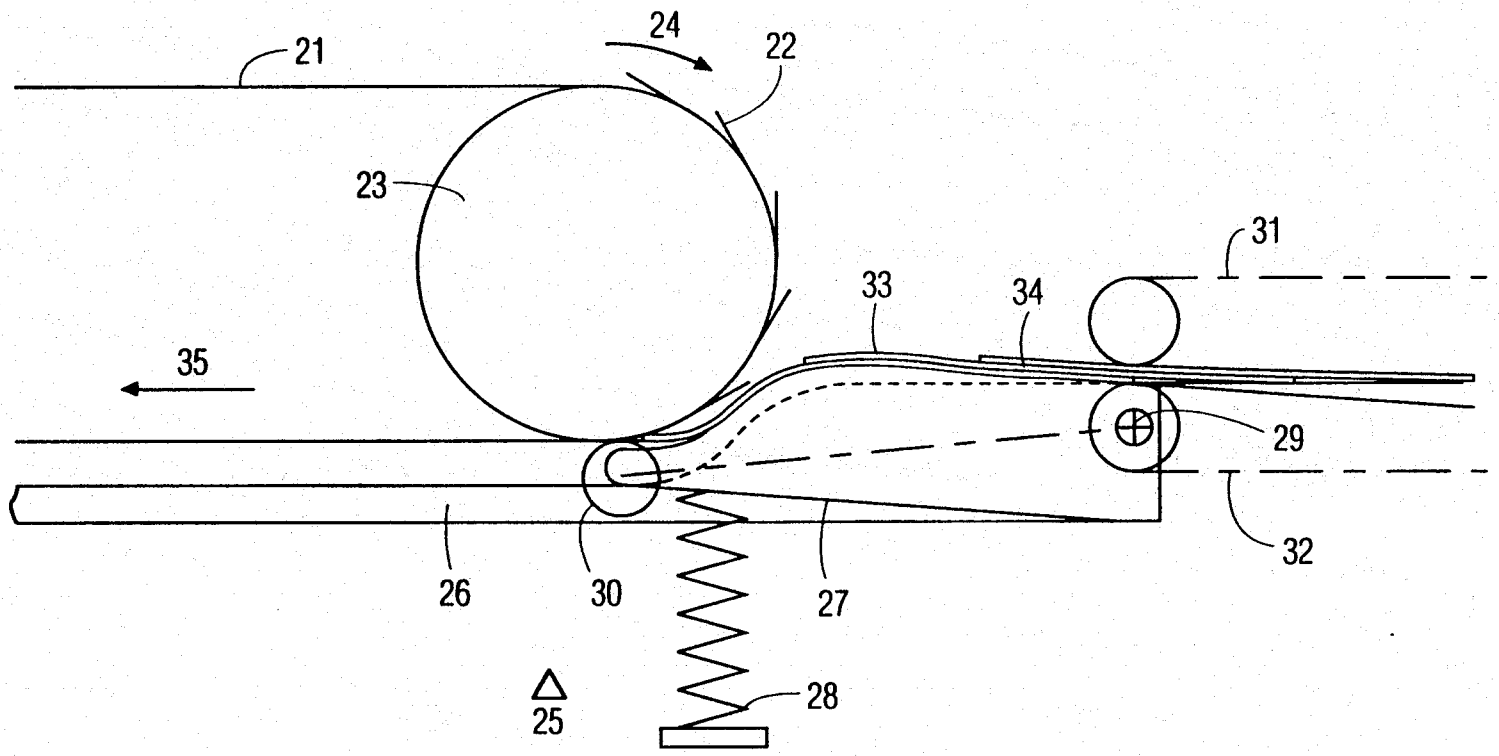
FIG. 6 illustrates the apparatus of FIG. 5 receiving and storing single sheets or only thin products.

FIGS. 5 and 6 illustrate another embodiment of the invention in which a steel ribbon 21 with tongues 22, all of which can be identical to the ribbon 1 with tongue 5, is guided over a guide roller 23. The tongues, however, in this embodiment, are so placed on the tape or ribbon that the opening of the tongues 22 is counter the direction of movement of the tape or ribbon 21, that is, counter the direction of arrow 24, which also illustrates the direction of rotation of the roller 23. A delivery system 25 is located beneath the guide roller 23. The delivery system 25 includes fixed guide sheets or guide elements 26 and one or more support elements 27. The support elements 27 are spring-loaded by a spring 28 and have a roller 13 at the end remote from their pivot point 29. Belt conveyors 31, 32 provide products 33, for example printed folded products in imbricated, or shingled arrangement. The circumferential speed of the guide roller 23 is arranged to be slower than the supply speed of the products 33, supplied by the transport belts 31, 32. Thus, the leading edges of the products 33 are supplied, in cadence or clocked timing, into the openings of the tongues 22, that is, they are pushed between the tongues 22 and the remainder of the ribbon or tape material. Upon subsequent linear guidance of the steel tape or ribbon 21 in the direction of the arrow 25, the products are clamped by the tongues 22.

The elements 27 are similarly shaped to the surface of the guide roll 23 in order to facilitate pushing the products 33 into the openings between the tongues and the remainder of the ribbon material, and cooperate with the roller 30, which scans or senses the thickness of the stream 34 of imbricated products when they are in engagement with the guide roller 23. The support elements 27 are pushed away from the guide roller 23, in steps, counter the pressure of the spring 28, until the lower edge of the support element 27 is in alignment with the run-out support element or guide element 26. When the stream of materials becomes thinner, for example with thinner materials, or slower supply of products, the support element 27 will move towards the roller 23, so that the support element 27 will always leave sufficient room for the products 33, but still remain in engagement with the products 33 to permit easy pushing of the products 33 between the tongues 22 and the remainder of the tape 21. After the products 33 have been gripped, the folded products, together with the tape 21, can be rolled into a storage roll, similar to storage roll 14 (FIGS. 1-2).

To release the folded products from the storage roll, it is only necessary to reverse the direction of rotation of the roller 23 and of the movement of the strip 21, which will again supply the products 33, in imbricated or shingled configuration, to a suitable removal apparatus, for example the transport or conveyor system 31, 32.

Various changes and modifications may be made within the scope of the inventive concept. For example, the tape or ribbon 1, 21 preferably is of steel, for example spring steel; other materials may be used as well.

I claim:

1. A device for receiving, storing and delivering printed products, comprising a flexible tape or ribbon defining a longitudinal direction, adapted to be passed about guide roller (4, 23), said tape or ribbon being formed with a plurality of generally U-shaped tongues (5, 22) cut into said tape or ribbon, which U-shaped tongues are uniformly spaced from each other along the longitudinal direction of the tape or ribbon, and define holding or gripper clips in combination with the material of the tape or ribbon surrounding the U-shaped tongues, said tongues, when the tape or ribbon is oriented in a flat plane, being essentially flush with the tape or ribbon material surrounding the tongues and, when being passed over said guide roller (4, 23), opening and spreading tangentially outwardly of the tape or ribbon and, upon subsequent guidance of the tape or ribbon in a planar path, being capable of gripping a printed product between the tongues and the tape or ribbon material surrounding the tongues;

a stack (8) of said printed products being positioned beneath the guide roller, said stack being movable vertically to place a printed product in interfering position with a tongue (5) of the flexible tape or ribbon (1); and means (18) for guiding said tape or ribbon in an essentially linear path laterally beyong the guide roller, whereby said tongues (5) will grip a printed product lifted off said stack (8) upon movement of said tape or ribbon in a direction (9) away from said stack.

2. The system of claim 1, wherein the tape or ribbon (1) is guided about said guide roller (4) in a direction in which the tongues (5), when open, form an open gripping jaw with the material of the tape or ribbon adjacent the tongues, in which the opening faces the direction of movement of the tape or ribbon (1); and suction means (12, 13) are provided located adjacent said guide roller and lifting an uppermost printed product (19) from said stack for placement into the opening formed by said tongue.

3. The system of claim 2, wherein said suction means are operated in clocked repetition synchronized with the movement of the tape or ribbon for lifting the uppermost product (19) into the openings defined by the tongues (5) as the tongues arrive above the stack.

4. The system of claim 2, further comprising vacuum means (16) and coupling means (15) connecting the vacuum means to the suction means (12, 13).

5. The system of claim 1, wherein said device, with products gripped between said tongues (5, 22) and the surrounding material of the tape or ribbon (121), is rolled into a storage roll (14).

6. The system of claim 1, wherein said flexible tape or ribbon, without products therebetween, is rolled into a tight supply roll (2), in which said tongues (5, 22) fit into a cut-out (7) where the tongues are cut from the tape or ribbon (1, 21).

7. A device for receiving, storing and delivering printed products, comprising a guide roller (4), a flexible tape or ribbon defining a longitudinal direction, adapted to be passed about the guide roller (4, 23), said tape or ribbon being formed with a plurality of generally U-shaped tongues (5, 22) cut into said tape or ribbon, which U-shaped tongues are uniformly spaced from each other along the longitudinal direction of the tape or ribbon, and define holding or gripper clips in combination with the material of the tape or ribbon surrounding the U-shaped tongues, said tongues, when the tape or ribbon is oriented in a flat plane, being essentially flush with the tape or ribbon material surrounding the tongues and, when being passed over said guide roller (4, 23), opening and spreading tangentially outwardly of the tape or ribbon and, upon subsequent guidance of the tape or ribbon in a planar path, being capable of gripping a printed product between the tongues and the tape or ribbon material surrounding the tongues;

said system further including means for removing printed products from the storage roll, with printed products retained between the tongues and the tape or ribbon material surrounding the tongues, said removing means including means (18) for orienting said tape or ribbon (1) in an essentially linear path and then passing the tape or ribbon about said guide roller (4); and engagement means (10, 11) positioned below said guide roller (4) for assembling the products (19) in a stack as the tongues (5) open from the ribbon material surrounding the tongues as the tape or ribbon is guided about said guide roller (4).

8. A device for receiving, storing and delivering printed products, comprising a flexible tape or ribbon defining a longitudinal direction, adapted to be passed about a guide roller (4, 23), said tape or ribbon being formed with a plurality of generally U-shaped tongues (5, 22) cut into said tape or ribbon, which U-shaped tongues are uniformly spaced from each other along the longitudinal direction of the tape or ribbon, and define holding or gripper clips in combination with the material of the tape or ribbon surrounding the U-shaped tongues, said tongues, when the tape or ribbon is oriented in a flat plane, being essentially flush with the tape or ribbon material surrounding the tongues and, when being passed over said guide roller (4, 23), opening and spreading tangentially outwardly of the tape or ribbon and, upon subsequent guidance of the tape or ribbon in a planar path, being capable of gripping a printed product between the tongues and the tape or ribbon material surrounding the tongues;

said system further including means (31, 32) including belt means (31, 32) for supplying said products (33) in imbricated or shingled form to said guide roller (23);

said tape or ribbon being guided over said guide roller in a direction in which the opening formed by the U-shaped tongues (22) with respect to the surrounding material of the tape or ribbon face counter the direction of movement of the tape or ribbon (21) about the guide roller, whereby the tongues will engage the leading edge of said products (23) fed by said feeding means, wherein the circumferential speed of the guide roller (23) is lower than the feeding speed of the products (33) fed by said belt means (31, 32) and a supply station (25), including a pivotable support member (27) located beneath the guide roller (23) and a fixed guide table or rail (26) positioned laterally beyond the guide roller (23).

9. The system of claim 8, wherein said pivotable supply member (27) is pivotably engaged against the imbricated products (33) to sense the thickness of the stream of imbricated products and includes a sensing head (30);

and resilient means (28) biassing said pivotable supply member against the stream of imbricated products and towards said guide roller (23).

10. The system of claim 8, wherein said device, with products gripped between said tongues (5, 22) and the surrounding material of the tape or ribbon (121), is rolled into a storage roll (14).

11. The system of claim 8, wherein said flexible tape or ribbon, without products therebetween, is rolled into a tight supply roll (2), in which said tongues (5, 22) fit into a cut-out (7) where the tongues are cut from the tape or ribbon (1, 21).

12. A device for receiving, storing and delivering printed products, comprising a guide roller (4), a flexible tape or ribbon defining a longitudinal direction, adapted to be passed about the guide roller (4, 23), said tape or ribbon being formed with a plurality of generally U-shaped tongues (5, 22) cut into said tape or ribbon, which U-shaped tongues are uniformly spaced from each other along the longitudinal direction of the tape or ribbon, and define holding or gripper clips in combination with the material of the tape or ribbon surrounding the U-shaped tongues, said tongues, when the tape or ribbon is oriented in a flat plane, being essentially flush with the tape or ribbon material surrounding the tongues and, when being passed over said guide roller (4, 23), opening and spreading tangentially outwardly of the tape or ribbon and, upon subsequent guidance of the tape or ribbon in a planar path, being capable of gripping a printed product between the tongues and the tape or ribbon material surrounding the tongues;

said system further including means (31, 32) including belt means (31, 32) for supplying said products (33) in imbricated or shingled form to said guide roller (23);

said tape or ribbon being guided over said guide roller in a direction in which the opening formed by the U-shaped tongues (22) with respect to the surrounding material of the tape or ribbon face counter the direction of movement of the tape or ribbon (21) about the guide roller, whereby the tongues will engage the leading edge of said products (23) fed by said feeding means;

wherein said products (33) held by said tongues (22) on said tape or ribbon (1,21) are rolled into a storage roll (14), and means are provided for guiding the tape or ribbon (21) in an essentially linear path and then about said guide roller (23) before rolling said tape or ribbon into said storage roll.

13. The system of claim 12, wherein, upon unrolling the storage roll (14) and guiding the tape or ribbon (21) about the guide roller (23) from below, said products (33) will be released from the tape or ribbon upon opening of the tongues (22) in imbricated or shingled form.

14. A device for receiving, storing and delivering printed products, comprising a flexible tape or ribbon defining a longitudinal direction, adapted to be passed about a guide roller (4, 23), said tape or ribbon being formed with a plurality of generally U-shaped tongues (5, 22) cut into said tape or ribbon, which U-shaped tongues are uniformly spaced from each other along the longitudinal direction of the tape or ribbon, and define holding or gripper clips in combination with the material of the tape or ribbon surrounding the U-shaped tongues, said tongues, when the tape or ribbon is oriented in a flat plane, being essentially flush with the tape or ribbon material surrounding the tongues and, when being passed over the guide roller (4, 23), opening and spreading tangentially outwardly of the tape or ribbon and, upon subsequent guidance of the tape or ribbon in a planar path, being capable of gripping a printed product between the tongues and the tape or ribbon material surrounding the tongues;

wherein said device, with products gripped between said tongues (5, 22) and the surrounding material of the tape or ribbon (121), is rolled into a storage roll (14).

15. A device for receiving, storing and delivering printed products, comprising a flexible tape or ribbon defining a longitudinal direction, adapted to be passed about a guide roller (4, 23), said tape or ribbon being formed with a plurality of generally U-shaped tongues (5, 22) cut into said tape or ribbon, which U-shaped tongues are uniformly spaced from each other along the longitudinal direction of the tape or ribbon, and define holding or gripper clips in combination with the material of the tape or ribbon surrounding the U-shaped tongues, said tongues, when the tape or ribbon is oriented in a flat plane, being essentially flush with the tape or ribbon material surrounding the tongues and, when being passed over the guide roller (4, 23), opening and spreading tangentially outwardly of the tape or ribbon and, upon subsequent guidance of the tape or ribbon in a planar path, being capable of gripping a printed product between the tongues and the tape or ribbon material surrounding the tongues;

wherein said flexible tape or ribbon, without products therebetween, is rolled into a tight supply roll (2), in which said tongues (5, 22) fit into a cut-out (7) where the tongues are cut from the tape or ribbon (1, 21).

* * * * *